US010280867B2

(12) United States Patent
Anetsberger et al.

(10) Patent No.: US 10,280,867 B2
(45) Date of Patent: May 7, 2019

(54) INJECTION VALVE FOR AN ACCUMULATOR INJECTION SYSTEM

(71) Applicant: Continental Automotive GmbH, Hannover (DE)

(72) Inventors: Daniel Anetsberger, Regensburg (DE); Tet Kong Brian Chia, Regensburg (DE); Walter Sassler, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 163 days.

(21) Appl. No.: 15/120,680

(22) PCT Filed: Feb. 10, 2015

(86) PCT No.: PCT/EP2015/052777
§ 371 (c)(1),
(2) Date: Aug. 22, 2016

(87) PCT Pub. No.: WO2015/128187
PCT Pub. Date: Sep. 3, 2015

(65) Prior Publication Data

US 2017/0009697 A1 Jan. 12, 2017

(30) Foreign Application Priority Data

Feb. 25, 2014 (DE) ..... 10 2014 203 364

(51) Int. Cl.
*F02D 41/38* (2006.01)
*F02D 41/20* (2006.01)
(Continued)

(52) U.S. Cl.
CPC ..... *F02D 41/3863* (2013.01); *F02D 41/20* (2013.01); *F02M 63/0052* (2013.01);
(Continued)

(58) Field of Classification Search
CPC ..... F02D 41/3863; F02D 41/20; F02D 2041/2034; F02D 2041/2051;
(Continued)

(56) References Cited

U.S. PATENT DOCUMENTS 4,653,447 A 3/1987 Linder et al. ..... 123/357
5,182,517 A 1/1993 Thelen et al. ..... 324/418
(Continued)

FOREIGN PATENT DOCUMENTS

DE 3426799 A1 1/1986 ..... F02D 35/00
DE 3817770 A1 11/1989 ..... F02D 41/20
(Continued)

OTHER PUBLICATIONS

Korean Office Action, Application No. 2017017600637, 10 pages, dated Mar. 9, 2017.
(Continued)

*Primary Examiner* — Hung Q Nguyen
*Assistant Examiner* — Brian P Monahon
(74) *Attorney, Agent, or Firm* — Slayden Grubert Beard PLLC

(57) ABSTRACT

The present disclosure relates to the field of electromechanics. The teachings may be applied to high-pressure valves, including methods for operating a valve and with devices which are used for activating the valves. Some embodiments include methods for operating a pressure reduction valve for an accumulator injection system, wherein the valve is driven, against a return spring, with an energizable coil and armature, between a closed position and an open position. The method may include: supplying the coil with a defined electrical signal to move the armature, sensing the current intensity profile over time, and determining a movement
(Continued)

profile for the defined current signal, including an opening or closing time, based at least in part on the current intensity profile over time.

10 Claims, 2 Drawing Sheets

(51) Int. Cl.
*F02M 63/00* (2006.01)
*F02M 63/02* (2006.01)

(52) U.S. Cl.
CPC ..... *F02M 63/023* (2013.01); *F02M 63/0265* (2013.01); *F02D 2041/2034* (2013.01); *F02D 2041/2051* (2013.01); *F02D 2041/2055* (2013.01); *F02D 2041/2058* (2013.01)

(58) Field of Classification Search
CPC .... F02D 2041/2055; F02D 2041/2058; F02M 63/0265; F02M 63/023; F02M 63/0052
See application file for complete search history.

(56) References Cited

U.S. PATENT DOCUMENTS 5,245,501 A 9/1993 Locher et al. ..... 361/154
5,277,163 A * 1/1994 Ohishi ..... F02D 41/20 123/458
5,375,575 A * 12/1994 Ohishi ..... F02D 41/0085 123/446
5,678,521 A * 10/1997 Thompson ..... F02M 63/00 123/446
5,715,797 A * 2/1998 Minagawa ..... F02D 41/3082 123/478
6,024,071 A * 2/2000 Heimberg ..... F02D 41/20 123/490
6,119,655 A * 9/2000 Heinitz ..... F02D 41/20 123/447
6,213,099 B1 * 4/2001 Calvas ..... F02D 41/20 123/490
6,257,205 B1 * 7/2001 Calvas ..... F02D 41/20 123/470
6,453,876 B1 * 9/2002 Fukutomi ..... F02D 41/20 123/490
6,832,601 B2 * 12/2004 Watanabe ..... F02D 41/20 123/480
8,826,889 B2 9/2014 Roth ..... 123/458
9,316,478 B2 4/2016 Wirkowski et al.
2007/0079809 A1 * 4/2007 Oono ..... F02D 41/3845 123/456
2008/0017172 A1 * 1/2008 Kojima ..... F02D 41/20 123/478
2008/0028843 A1 2/2008 Dietl et al. ..... 73/114.45
2008/0087254 A1 * 4/2008 Tanaka ..... F02D 41/20 123/472
2009/0018747 A1 * 1/2009 Nitta ..... F01L 1/08 701/102
2010/0095936 A1 * 4/2010 Schempp ..... F02D 41/2096 123/478
2011/0022290 A1 * 1/2011 Kaneko ..... F02D 41/222 701/103
2011/0315124 A1 * 12/2011 Richter ..... F02D 41/20 123/480
2012/0000445 A1 * 1/2012 Borg ..... F02D 41/3845 123/497
2012/0042853 A1 * 2/2012 Sakata ..... F02D 41/3863 123/447
2012/0221226 A1 * 8/2012 Dolker ..... F02D 41/1401 701/103
2012/0265424 A1 * 10/2012 Dolker ..... F02D 41/222 701/104
2014/0034025 A1 * 2/2014 Nishimura ..... F02M 69/04 123/478
2015/0053181 A1 2/2015 Zhang et al. ..... 123/456
2015/0263648 A1 * 9/2015 Wirkowski ..... F02D 41/2438 251/129.04
2016/0281624 A1 * 9/2016 Dames ..... F02D 41/40

FOREIGN PATENT DOCUMENTS

DE 3843138 A1 6/1990 ..... B60T 8/36
DE 3942836 A1 6/1991 ..... F02D 41/20
DE 10111293 A1 9/2002 ..... F02M 47/02
DE 102006036568 A1 2/2008 ..... F02D 41/20
DE 102007031552 A1 1/2009 ..... H01F 7/18
DE 102007059116 A1 6/2009 ..... F02D 41/00
DE 102010039832 A1 3/2012 ..... F16K 31/02
DE 102012204252 B3 8/2013 ..... F02M 51/06
EP 0563760 A2 10/1993 ..... F02D 41/00
WO 03/081007 A1 10/2003 ..... F02D 41/20
WO 2009/080426 A1 7/2009 ..... F02M 63/00
WO 2015/128187 A1 9/2015 ..... F02D 41/20

OTHER PUBLICATIONS

DE 3426799 A1 U.S. Pat. No. 4,653,447 A.
DE 3843138 A1 U.S. Pat. No. 5,245,501 A.
DE 3942836 A1 U.S. Pat. No. 5,182,517 A.
DE 102006036568 A1 US 2008/0028843 A1.
WO 2009/080426 A1 U.S. Pat. No. 8,826,889 B2.
DE 102010039832 A1 U.S. Pat. No. 9,316,478 B2.
DE 102012204252 B3 US 2015/0053181 A1.
German Office Action, Application No. 102014203364.0, 5 pages, dated Sep. 24, 2014.
International Search Report and Written Opinion, Application No. PCT/EP2015/052777, 22 pages, dated May 22, 2015.
Chinese Office Action, Application No. 201580010529.4, 15 pages, dated Jan. 12, 2018.

* cited by examiner

INJECTION VALVE FOR AN ACCUMULATOR INJECTION SYSTEM

CROSS-REFERENCE TO RELATED APPLICATIONS

This application is a U.S. National Stage Application of International Application No. PCT/EP2015/052777 filed Feb. 10, 2015, which designates the United States of America, and claims priority to DE Application No. 10 2014 203 364.0 filed Feb. 25, 2014, the contents of which are hereby incorporated by reference in their entirety.

TECHNICAL FIELD

The present disclosure relates to the field of electromechanics. The teachings may be applied to high-pressure valves, including methods for operating a valve and with devices which are used for activating the valves. Some embodiments include high-pressure valves for use in common rail injection systems in automobile technology.

BACKGROUND

In the following, the field of common rail injection technology will be outlined briefly as a particularly attractive field of use of the teachings herein. However, the invention can also be used in other technical fields in which efficient activation is useful.

Fuel injection devices for internal combustion engines are extensively known from automobile technology. High-pressure injection systems with accumulators, in which the fuel to be injected is accumulated at a pressure of many hundreds of bars and is led into combustion chambers via injection valves, have proven to be particularly efficient.

To operate such a high-pressure injection system, regulation of the pressure in the high-pressure accumulator, which usually in particular activates a high-pressure pump with a manipulated variable, is required. Additionally known from the literature are so-called pressure reduction valves, which are either integrated into individual injection valves (e.g. DE 101 11 293 A1) or are generally mentioned in the description of control systems for accumulator injection systems (e.g. DE 10 2007 059 116 A1). Also known from DE 10 2012 204 252 B3 is a pressure reduction valve which is integrated in an injection valve.

Such a pressure reduction valve is very useful for efficient regulation of the pressure in the accumulator, since the high-pressure pump can be used exclusively for the pressure build-up and since, in the event of changes in the reference variable, for example in the event of a change in the operation of the internal combustion engine, a fast pressure reduction is occasionally necessary but is not expediently possible via the injection valves alone. The consequence would be so-called hard combustion, which is not desired during operation of the internal combustion engine.

In order to permit an efficient pressure reduction in this way, it is known in such a control system also to provide a magnetically controlled pressure reduction valve which can be activated electrically. When activating such a valve, it is important that the volume of liquid let through can be controlled accurately, in that the valve can be opened and closed in a very well defined manner. This is usually achieved in that very fast opening and closing are achievable by means of an electromagnetic drive, so that the valve can virtually be switched digitally between an opened and a closed position, so that only the time period of the opening decides on the volume of liquid let through. Such a drive leads in turn to high acceleration values of the mechanical parts of the valve, i.e. in particular a closure element which opens and closes a valve opening. Such a high acceleration in turn firstly generates noises, which can be annoying, and wear in the area of the sealing faces.

SUMMARY

The present disclosure provides methods for operating a valve which permit low-noise operation with, in addition, reduced mechanical wear of the valve.

Some embodiments may include a method for operating a valve (10), in particular a pressure reduction valve for an accumulator injection system, where the valve (10) has a valve opening (12) and a closure element (13) which can be driven, against the force of a return spring element (16), by means of an electromagnetic drive (14, 15) with an energizable coil (15) and a magnetically drivable armature (14), between a first end position (closed position), in which it effects closure of the valve opening (12), and a second end position (open position), in which it at least partially unblocks the valve opening, characterized in that the coil (15) is supplied with a defined electrical signal, at least once, in order to move the armature (14) under the influence of the return spring, in particular against the force of the return spring element (16), in that the current intensity profile over time (20, 21, 22) in the coil (15) is sensed by a current sensor, and in that the movement profile of the closure element (13) for the defined current signal, in particular an opening or closing time, is determined from the current intensity profile over time.

In some embodiments, the coil (15) is supplied successively with multiple different electrical signals and the differences in the current time profiles (20, 21, 22) and the movement data of the armature (14) determined therefrom are evaluated.

In some embodiments, the chronologically first minimum (20*a*, 21*a*, 22*a*) of the current intensity of the current flowing through the coil (15) is determined.

In some embodiments, the time period between the start of the supply of the coil (15) with an electrical signal and the occurrence of the first minimum (20*a*, 21*a*, 22*a*) of the current intensity of the current flowing through the coil (15) is determined.

In some embodiments, the coil (15) is supplied successively with electrical signals of different intensity and respective movement data of the armature (14) is acquired.

In some embodiments, the intensity of the electrical signals from signal supply to signal supply either rises or falls monotonically and in that the time periods in each case from the start of the signal supply until the passage through the first minimum (20*a*, 21*a*, 22*a*) of the current intensity of the current flowing through the coil (15) are measured and compared with one another.

In some embodiments, the intensity differences between the electrical signals following one another and/or immediately adjacent to one another in the series of signal intensities are substantially the same.

In some embodiments, respective pairs of signals which are immediately adjacent in the series of signal intensities are compared with one another with respect to the achieved movements of the armature (14), in particular the time periods to pass through the first current minimum (20*a*, 21*a*, 22*a*), and in that the pair which exhibits the greatest difference in the armature movements is determined, and in that that one of the two electrical signals which leads to the chronologically shorter time period before reaching the current minimum is selected.

In some embodiments, the valve (10) is held in a closed position by a spring (16) and is opened by means of an armature (14) drivable by an energizable coil (15), in that the coil (15) is supplied successively with various electrical signals, the intensities of which decrease from signal to signal, in that for each signal, by means of a measurement of the current flowing through the coil, a time period until the impact of the closure element (13) in the open position is determined and, in that, by using a significant increase in the time period, the first signal which leads to a delayed opening operation of the valve on account of its inadequate intensity is determined.

In some embodiments, the weakest signal which, with respect to the time period achieved until the impact of the closure element (13), is determined to be adequate, is reproduced for further actuating operations.

Some embodiments may include an accumulator injection system having a high-pressure pump (6) which delivers an injection liquid under high pressure into a high-pressure accumulator (1), and having a pressure reduction valve (10) which is connected to the high-pressure accumulator (1) and, by means of an energizable electromagnet (14, 15), can be opened and/or closed against the force of a return spring element (16), having a signal generating device which successively effects the generation of different electrical signals with different intensities, and having a current sensor for sensing the current intensity profile (20, 21, 22) of the current flowing through a coil (15) of the electromagnet.

Some embodiments may include an evaluation device which, on the basis of the determination of the chronological position of current intensity minima (20*a*, 21*a*, 22*a*) of the current flowing through the coil (15) of the electromagnet (14, 15), compares the closing times and/or opening times of the valve for electrical signals of different intensity with one another.

BRIEF DESCRIPTION OF THE DRAWINGS

In the following text, the teachings of the present disclosure will be shown in a number of figures by using exemplary embodiments and then explained. In the figures.

DETAILED DESCRIPTION

Figure 1:
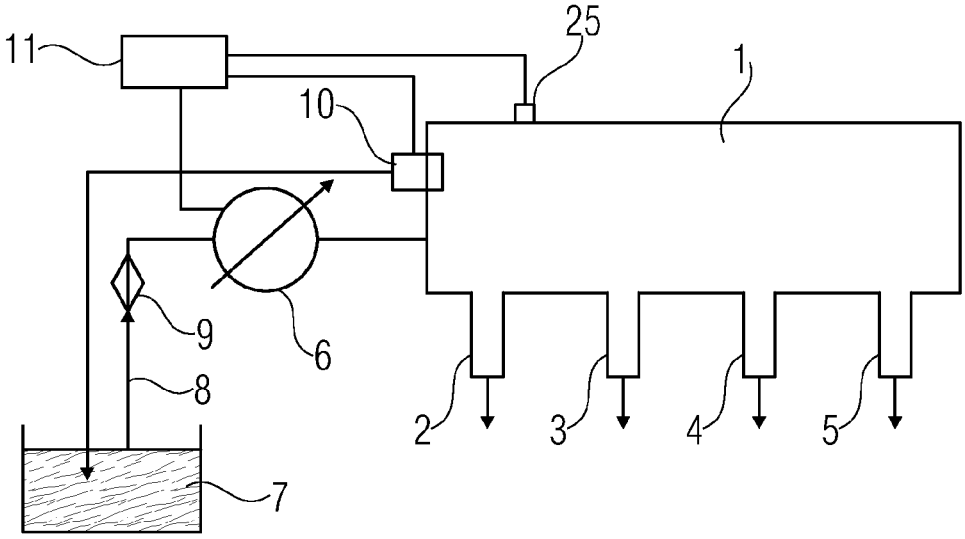
FIG. 1 shows a general illustration in schematic form of an accumulator injection system with a pressure reduction valve.

Accordingly, the present teachings relates to a method for operating a valve, in particular a pressure reduction valve for an accumulator injection system, where the valve has a valve opening and a closure element which can be driven, against the force of a return spring element, by means of an electromagnetic drive with an energizable coil and a magnetically drivable armature, between a first end position, in which it effects closure of the valve opening, and a second end position, in which it at least partially unblocks the valve opening.

In some embodiments, the coil is supplied with a defined electrical signal, at least once, in order to move the armature against the force of the return spring element, in that the current intensity profile over time in the coil is sensed by a current sensor, and in that the movement profile of the closure element for the defined current signal, in particular an opening or closing time, is determined from the current intensity profile over time.

The drive of such an armature, which is connected to a closure element of the valve or can be at least partly identical to the latter, is normally effected by a defined electrical signal, for example a voltage pulse. It is also common to activate such a drive with pulse width modulated signals.

In some embodiments, intensive activation signals permit fast switching but hitherto such signals were not optimized with respect to the required acceleration and the overall mechanical/magnetic system. From a certain point increasing the signal intensity barely leads to further acceleration of the moving parts of the valve, but leads to an input of energy into the magnetic field of the drive coil, with the known effect that the current rise is slowed by the inductance of the drive coil.

On the other hand, a reduction in the signal intensity firstly does not lead to any slowing of the drive but merely to a reduction in the magnetic energy which is put into the drive system. A detailed consideration of the current generated in the drive coil with regard to any electrical signal results in the fact that, firstly, a current rise is effected, the slope of which is determined by the inductance of the coil, that, after passing through an overswing/maximum of the current intensity during opening of the valve or when the moving armature or the closure element strikes the valve seat, a current minimum is passed through, and that after that the current which flows through the drive coil rises only a little again in order to end in a quasi-constant current profile.

In the description of the following embodiment, the opening operation of a valve is drive-assisted. At some points, reference will be made explicitly to a closing operation, which can likewise be drive-assisted. In this case, a return spring can optionally keep the valve in a closed position without the influence of the drive. The invention can in each case be applied both to an opening and to a closing movement.

During operation, depending on the environmental conditions, such as temperature, friction and so on, variable conditions result for the operation of a valve and thus respectively different minimum conditions for the signal intensity which is needed for reliable and fast closing/opening of the valve. The current behavior of the valve for a specific electric activation signal can be determined by monitoring the current intensity in the drive coil.

Then, for example by means of comparison with intended times, it is possible to determine whether the valve closes sufficiently quickly with the signal used. If too short a reaction time is determined, it can also be concluded that the acceleration is too high and the closure element strikes too hard. In this case, the signal could be attenuated by a defined amount for the further operation of the valve. If the opening time, i.e. that from the start of the opening signal until the impact of the closure element, lies within a predefined window, then the signal can be maintained for the further operation.

Often, however, it is difficult in particular to identify excessively high signal intensities, since, in the case of excessively intensive signals which lead to undesired noises and wear, the opening time can barely be shortened further. In this case, the coil may be supplied successively with multiple different electrical signals and the differences in the current time profiles and the movement data of the armature determined therefrom may be evaluated. Thus, during the operation of the valve, a series of different signals with different intensities can be tested in order to find out which is the lowest signal intensity with which non-delayed actuation of the valve with minimal impact velocity is still possible.

The signals can be varied, for example, in that the voltage level of the applied voltage signal is chosen differently. Usually, when a pulse width modulated signal (PWM signal) is used, the clock cycle, that is to say the ratio of the switching times between a high signal level and a low signal level, is controlled appropriately. For example, with a PWM signal, a start may be made with a clock cycle of 100%, i.e. a continuously complete signal, and this can be reduced step by step from signal to signal by a few percent. Such pulse width modulated signals are usually high-frequency and are generated in the form of a square wave pulse. A further possibility would be to reduce the duration of the 100% PWM phase continuously until the opening time is shifted.

The movement data of the valve can be determined in various ways during the testing of different electrical signals. For example, the time until the closure element strikes can be measured acoustically or optically if the chronological position of the activation signal is known accurately. However, this requires an outlay on measurement which is not always practical, in particular in daily operation in an internal combustion engine.

In some embodiments, the chronologically first minimum of the current intensity of the current flowing through the coil is determined. Here, the time period between the start of the supply of the coil with an electrical signal and the occurrence of the first minimum of the current intensity of the current flowing through the coil may be determined.

It is therefore possible for the current profiles for various electrical signals to be compared, and it is possible to establish which signal intensities lead to a considerable time delay of the impact, measured by using the position of the current minimum in the drive coil. It is then possible for the respectively next more intense/stronger signal to be chosen for the activation of the valve, in order to achieve the desired reaction time of the valve with a minimal increase in the kinetic energy during the impact of the closure element. Therefore, lower-noise and lower-wear operation of the valve is made possible.

In general, the coil may be supplied successively with electrical signals of different intensity and respective movement data of the armature may be acquired.

In some embodiments, the intensity of the electrical signals from signal supply to signal supply either rise or fall monotonically and the time periods in each case from the start of the signal supply until the passage through the first minimum of the current intensity of the current flowing through the coil may be measured and compared with one another.

In order to manage with as few test signals as possible and nevertheless to reach an optimized activation signal, provision can further advantageously be made for the intensity differences between the electrical signals following one another and/or immediately adjacent to one another in the series of signal intensities to be substantially the same.

In some embodiments, respective pairs of signals which are immediately adjacent in the series of signal intensities are compared with one another with respect to the achieved movements of the armature, in particular the time periods to pass through the first current minimum, and the pair which exhibits the greatest difference in the armature movements is determined, and one of the two electrical signals which leads to the chronologically shorter time period before reaching the current minimum may be selected.

When considering the movement data of the valve, it is expedient to order the different passages in accordance with the applied signal intensity. The result is that, above a specific signal intensity, no further substantial change is detectable in the valve speed, i.e., the impact velocity at the impact of the closure element, and also the time between the start of the activation signal and the closure of the valve. Only when a signal falls below a specific signal threshold is the result that the closure element reaches the opening position or the closed position, i.e., the position of the greatest possible opening, only with a delay. A further reduction in the signal intensity leads to the valve no longer reliably opening or closing. The two signal profiles, in the series of signal profiles ordered in accordance with signal intensities, between which there is the greatest difference in the reaction of the valve, may be identified. These two signals mark the signal intensity which just still leads to smooth valve opening or closing without reaching an unnecessarily high impact velocity. The more intensive of these two signals should be chosen for the further operation of the valve, since the weaker of the two signals already leads to a delay in the system response.

Therefore, during operation of the valve, from time to time, for example periodically, the valve is supplied with test signals in order in each case to determine the currently optimized activation signal. During operation, at each actuation of the valve, monitoring of the opening time or closing time is carried out via a current measurement and, in the event of a change in the respective time, appropriate test signals for tracking the optimized signal intensity are applied.

In some embodiments, the valve is held in a closed position by a spring and is opened by means of an armature drivable by an energizable coil, in that the coil is supplied successively with various electrical signals, the intensities of which decrease from signal to signal, in that for each signal, by means of a measurement of the current flowing through the coil, a time period until the impact of the closure element in the open position is determined and, in that, by using a significant increase in the time period, the first signal which leads to a delayed opening operation of the valve on account of its inadequate intensity is determined. A corresponding method can also be used for the optimization of the valve closure.

In some embodiments, the weakest signal which, with respect to the time period achieved until the impact of the closure element, is determined to be adequate, may be used for further valve opening and/or closing operations.

In some embodiments, a method for operating a valve in the manner explained above may also be engages on an accumulator injection system, having a pressure-generating high-pressure pump which delivers an injection liquid under high pressure into a high-pressure chamber, and having a pressure reduction valve which is connected to the high-pressure chamber and, by means of an energizable electromagnet, can be opened and/or closed against the force of a return spring element, having a signal generating device which successively effects the generation of different electrical signals with different intensities, and having a current sensor for sensing the current intensity profile of the current flowing through a coil of the electromagnet.

In such an accumulator injection system, an evaluation device which, on the basis of the determination of the chronological position of current intensity minima, may compare the opening times and/or closing times of the valve with electrical signals of different intensity with one another.

FIG. 1 shows an example high-pressure injection system for a four-cylinder internal combustion engine, which is not illustrated in detail. The injection system has a high-pressure accumulator 1, which is connected to four injectors 2, 3, 4, 5. The individual injectors 2, 3, 4, 5 each have injection valves, which are indicated schematically in FIG. 1.

The high-pressure accumulator 1 is fed with a fuel from a fuel reservoir 7 by means of a high-pressure pump 6 under high pressure (e.g., in the region of several hundred bar). The fuel is fed to the high-pressure pump 6 via a fuel line 8 and a filter 9. The hydraulic pressure in the high-pressure accumulator 1 may be regulated, in that the volume of fuel fed to the high-pressure pump on the low-pressure side is regulated.

In order to permit improved regulation of the pressure in the high-pressure accumulator, in particular in situations of a falling fuel demand, some embodiments include a pressure reduction valve 10, which connects the high-pressure accumulator 1 to the low-pressure system, in particular the fuel reservoir 7. When the pressure reduction valve 10 is open, the pressure in the high-pressure accumulator 1 can thus be reduced efficiently and rapidly.

The pressure reduction valve 10 and an element which controls the fuel feed to the high-pressure pump 6 may be connected, together with a pressure sensor 25, to a common control system 11.

Figure 2:
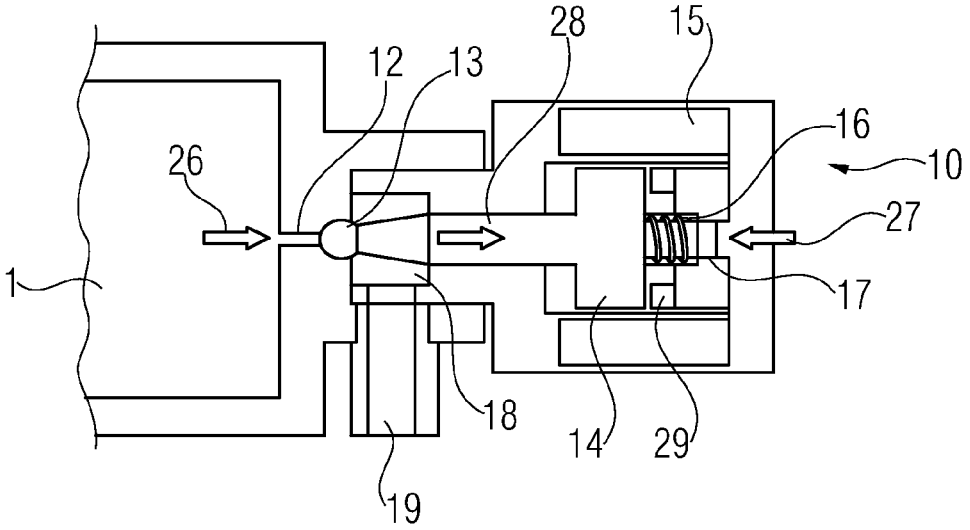
FIG. 2 shows, schematically, the structure of a pressure reduction valve.

FIG. 2 shows, schematically, the structure of the pressure reduction valve 10. Here, the high-pressure accumulator, which is connected to an opening 12 of the pressure reduction valve 10, is illustrated on the left-hand side by the designation 1. The opening 12 can be closed by means of a closure element 13. The closure element 13 is connected to an armature 14 of a magnetic drive, wherein the armature 14 interacts with a coil 15 surrounding the same within the context of the magnetic drive. In the rest state, i.e. when the coil 15 is not supplied with a current, by means of a spring 16 which is guided in a spring guide 17, and the correspondingly acting spring force, the armature 14 and with the latter the closure element 13 is forced against the valve seat at the opening 12, and thus the pressure reduction valve is closed against the hydraulic pressure 26 in the high-pressure accumulator 1. It is thus not possible for any fuel to emerge from the high-pressure accumulator 1.

If the coil 15 is supplied with an electrical signal, so that a current flows, then the armature 14 is drawn into the coil 15 by the magnetic force and therefore the closure element 13 is moved away from the opening 12 against the force of the spring 16. It is then possible for fuel to be led away from the high-pressure accumulator 1 through the opening 12 into the valve chamber 18 and from there via the outlet line 19 into the fuel reservoir 7. The pressure reduction valve 10 is constructed in such a way that it can advantageously be operated as a so-called digital valve. This means that the valve is operated substantially only in an open position and in a closed position, wherein the opening 12 can be closed and unblocked very quickly by the movement of the closure element 13. The drive must be configured here in such a way that intermediate positions, in which the valve opening 12 is only partly open, can be disregarded during the consideration and calculation of flow rates.

Accordingly, electrical signals for activating the coil 15 by means of which the closure element 13 is driven should be chosen or configured in such a way that the armature 14 is moved as quickly as possible. On the other hand, it is necessary to take account of the fact that the impact of the closure element 13 on the valve seat in the region of the opening 12 and/or on the stop 29 in the open position firstly causes mechanical wear and secondly generates noises, which are possibly undesired.

Some embodiments include determining suitable signal intensities for the electric activation signal of the coil 15.

For this purpose, in each case at the start of the operation or else during the operation, a series of test signals may be applied to the coil 15 and in each case the behavior of the valve is determined. To this end, in practical terms, the response time, i.e., the time from the start of the electrical signal as far as the complete closure of the valve or as far as the complete opening, is determined. This is done by observing the coil current, more precisely the time profile of the coil current. The latter depends firstly on the shape and intensity of the electrical signal, secondly on the inductance of the coil and the position of the armature 14 and on the stiffness and direction of action of the spring 16.

The current behavior will be considered in more detail below by using FIG. 3.

Figure 3:
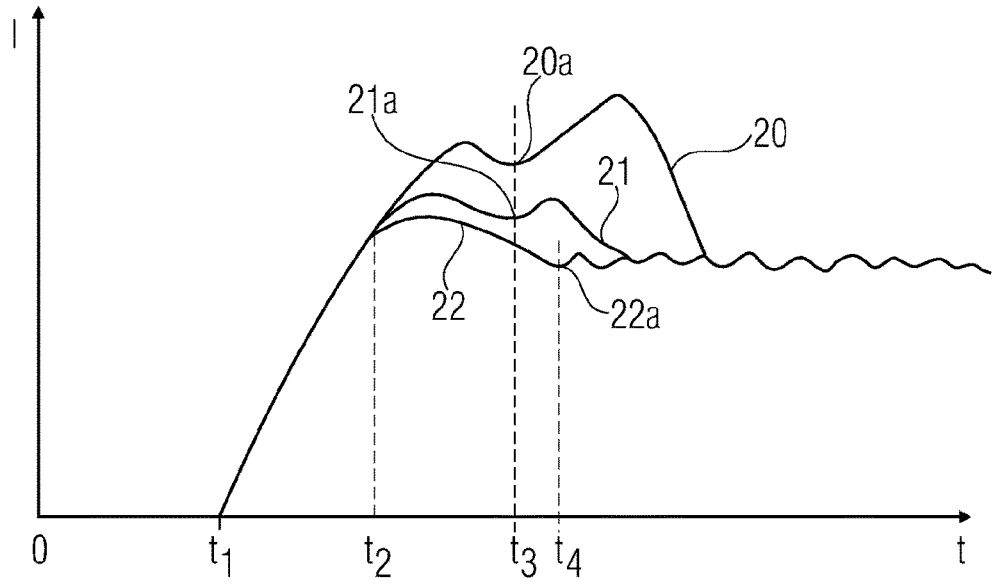
FIG. 3 shows a diagram in which the coil current in the drive coil of the pressure reduction valve is plotted against the time.

FIG. 3 illustrates three current curves 20, 21, 22, which result with differently intensive electrical signals applied to the coil 15 and which each reproduce the current profile in the coil 15. The result is that, at the start, when the electrical signal is applied to the coil at the time $t_1$, a current rise takes place which is initially determined exclusively by the inductance of the system comprising coil and armature and the armature mass. Only at the time $t_2$ do differences result, in that in the case of a more intensive signal, shown by using the example of the curve 20, a higher maximum current intensity is achieved than in the cases of a less intensive electrical signal. Given a closer consideration of the coupled electrical and mechanical system and the differential equation describing the latter, the result is that, following an overswing of the current intensity and the reaching of the maximum velocity of the armature as the latter strikes the valve seat, a relative minimum of the current intensity is passed through.

The current intensity minimum is designated in the curve 20 by the designation 20*a*, in the curve 21 by the designation 21*a* and in the curve 22 by the designation 22*a*. The result, given a comparison of the current curves 20 and 21, is that in the event of a reduction in the signal intensity of the signal applied to the coil 15, firstly the maximum current intensity reached falls but the time at which the current minimum 20*a*, 21*a* is reached is virtually not displaced. This is to be explained in that the mechanical acceleration of the closure element is not changed further above a specific signal intensity, and that more intensive electrical signals merely lead to a more intense input of energy into the magnetic field of the coil but not to any increase in the kinetic energy of the armature or to a shortening of the opening/closing time of the valve. Accordingly, the signal intensity can be lowered a little further without the closure time $t_3$ or the time period between the start of the signal $t_1$ and reaching the end position of the closure element $t_3$ changing.

If, then, the signal intensity is lowered still further, then, downward from a specific signal intensity, the total energy input is no longer sufficient to accelerate the closure element 13 maximally. This is shown in a consideration of the curve 22, in which the minimum 22*a* is shifted considerably to the right. This means that the closure element 13 strikes in a considerably slowed manner in the end position, for example on the valve seat. The result is therefore that the valve, strictly speaking, can no longer be viewed as a digital valve, since the closure element is found over an impermissibly large time period in positions in which it closes the valve opening partly. On the other hand, the impact of the closure element 13 on the valve seat is very soft, so that the valve closes with little noise and little wear.

If a test series is carried out with three different signal intensities, as illustrated in FIG. 3, then it is possible to draw the conclusion that the curve 22 reproduces an intensive signal which is inadequate for the purposes of the pressure reduction valve, so that after the test series has been run through, the next more intensive electrical signal, which is associated with the curve 21, is selected for the further operation.

In the test series, a greater number of electrical signals can also be applied and tested, wherein the differences between the signal intensities should be chosen in accordance with the accuracy which is desired for the operation of the pressure reduction valve.

The intensity of the applied electrical signals is usually determined by an applied voltage which, by means of pulse width modulation via an adjustable clock ratio, can be applied in a correspondingly adjustable percentage proportion of the elapsed signal time. A test series can, for example, begin with a 100% switched-on pulse width modulation signal and then be reduced percentage-wise or in steps of a few percent, in that, for example, the signal is switched on for 95% or 90% of the elapsed time during a test pass.

Figure 4:
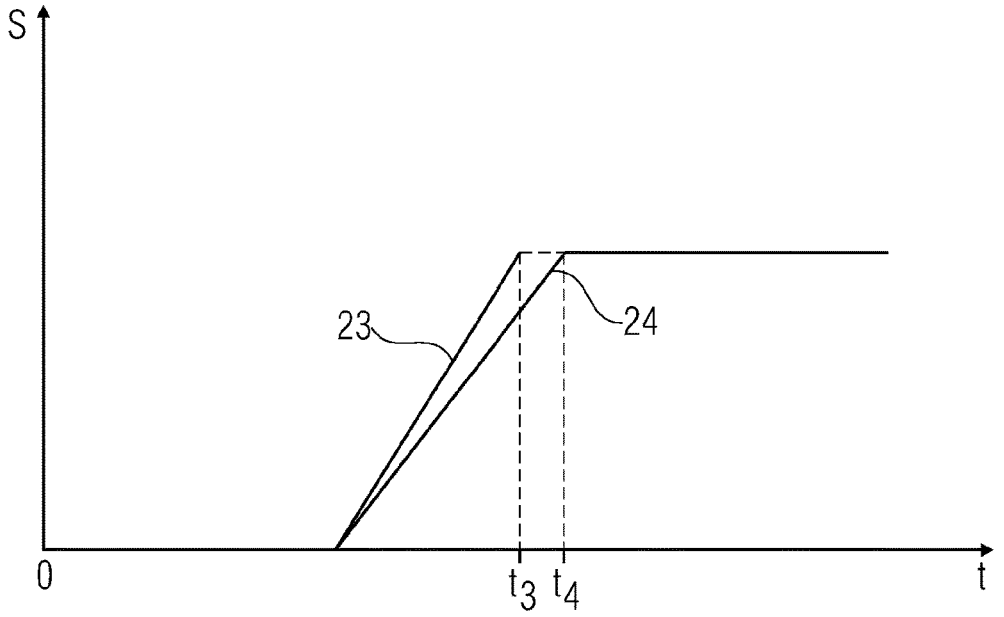
FIG. 4 shows a diagram in which the stroke of the pressure reduction valve is plotted against the time.

In FIG. 4, on the same time scale as in FIG. 3, the stroke s of the closure element 13 is plotted against the time t in the case of different signals. Here, in the displacement curve 23 a stroke profile is illustrated which is associated with the curve 21 in FIG. 3, while in the displacement curve 24 a stroke profile is illustrated which is associated with a curve 22 in FIG. 3. It reveals that, in the case of the displacement curve 23, the displacement as far as the closure of the valve opening 12 or until the end position is reached has been passed at the time $t_3$, which means that the valve closes at the time $t_3$. According to the displacement curve 24, which reproduces a signal intensity classified as too low, the valve is closed only at the time $t_4$.

After passing through an appropriate series of tests, it is thus possible to set in the pressure reduction valve a signal intensity which, whilst maintaining the optimized closure time of the valve, ensures a minimal noise level during operation and likewise minimized wear.

What is claimed is:

1. A method for operating a pressure reduction valve for an accumulator injection system, wherein the valve has a valve opening and a closure element driven, against the force of a return spring element, by means of an electromagnetic drive with an energizable coil and a magnetically drivable armature, between a closed position, in which the magnetically drivable armature effects closure of the valve opening, and an open position, in which the magnetically drivable armature at least partially unblocks the valve opening, the method comprising: supplying the coil with a defined electrical signal to move the armature against the force of the return spring element, sensing a current intensity profile over time in the coil with a current sensor, determining a movement profile of the closure element for the defined electrical signal, including an opening or closing time, based at least in part on the current intensity profile over time; supplying the coil successively with electrical signals of different intensities; acquiring respective movement data of the armature for each electrical signal; comparing respective pairs of electrical signals immediately adjacent in the series of electrical signal intensities with one another with respect to the achieved movements of the armature; identifying time periods for which the current signal passes through a first current minimum; determining the respective pair of electrical signals exhibiting the greatest difference in the armature movements; and selecting one of the two electrical signals from the respective pair leading to a shorter time period elapsed before reaching the current minimum.

2. The method as claimed in claim 1, further comprising:

supplying the coil successively with multiple different electrical signals; and determining the differences in the current time profiles and the movement data of the armature therefrom.

3. The method as claimed in claim 1, further comprising determining a chronologically first minimum of the current intensity of the current flowing through the coil.

4. The method as claimed in claim 3, further comprising determining a time period between the start of the supply of the coil with an electrical signal and the occurrence of the first minimum of the current intensity of the current flowing through the coil.

5. The method as claimed in claim 1, wherein the intensity of the electrical signals from signal supply to signal supply either rises or falls monotonically; and further comprising:

measuring the time periods in each case from the start of the signal supply until the passage through the first minimum of the current intensity of the current flowing through the coil are measured; and comparing the measured time periods with one another.

6. The method as claimed in claim 1, further comprising: comparing respective pairs of electrical signals immediately adjacent in the series of signal intensities with one another with respect to the achieved movements of the armature; identifying the time periods to pass through the first current minimum; determining the pair exhibiting the greatest difference in the armature movements; and selecting one of the two electrical signals which leads to the chronologically shorter time period before reaching the current minimum.

7. The method as claimed in claim 1, further comprising: holding the valve in a closed position with a spring; and opening the valve with an armature driven by an energizable coil; wherein the coil is supplied successively with various electrical signals, the intensities of which decrease from signal to signal, in that for each signal, by means of a measurement of the current flowing through the coil; determining a time period until the impact of the closure element in the open position; and determining, by using a significant increase in the time period, the first signal which leads to a delayed opening operation of the valve on account of the first signal's inadequate intensity.

8. The method as claimed in claim 7, further comprising determining the weakest signal which, with respect to the time period achieved until the impact of the closure element, is adequate; and reproducing the determined weakest adequate signal for further actuating operations.

9. An accumulator injection system comprising: a high-pressure pump delivering an injection liquid under high pressure into a high-pressure accumulator; a pressure reduction valve connected to the high-pressure accumulator; an energizable electromagnet configured to open or close the pressure reduction valve against the force of a return spring element; a signal generating device generating different electrical signals with different intensities; and a current sensor for sensing the current intensity profile of the current flowing through a coil of the electromagnet; and a processor configured to analyze an output from the current sensor; wherein the signal generating device supplies the coil successively with electrical signals of different intensity; the current sensor configured to acquire respective movement data of the pressure reduction valve for each electrical signal; the processor configured to compare respective pairs of signals immediately adjacent in the series of signal intensities with one another with respect to the achieved movements of the armature, to identify time periods for which the current signal passes through a first current minimum, to determine the respective pair of signals exhibiting the greatest difference in the armature movements, and to select selects one of the two electrical signals from the respective pair leading to a shorter time period elapsed before reaching the current minimum.

10. The accumulator injection system as claimed in claim 9, further comprising an evaluation device configured to:

determine the chronological position of current intensity minima of the current flowing through the coil of the electromagnet; and compare the closing times or opening times of the valve for electrical signals of different intensity with one another.

* * * * *